US007162812B2

(12) United States Patent
Cimetta et al.

(10) Patent No.: US 7,162,812 B2
(45) Date of Patent: Jan. 16, 2007

(54) CLOTHES DRYING MACHINE WITH CLOTHES SMOOTHING ABILITY

(75) Inventors: Silvano Cimetta, Treviso (IT); Fabio Noviello, Aviano (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 11/042,309

(22) Filed: Jan. 25, 2005

(65) Prior Publication Data

US 2005/0172511 A1 Aug. 11, 2005

(30) Foreign Application Priority Data

Feb. 10, 2004 (EP) ..... 04100490

(51) Int. Cl.
*F26B 3/00* (2006.01)
*F26B 21/06* (2006.01)

(52) U.S. Cl. ..... 34/469; 34/77

(58) Field of Classification Search ..... 34/467, 34/468, 469, 77, 604, 605, 134, 607; 68/20, 68/18 C See application file for complete search history.

(56) References Cited

U.S. PATENT DOCUMENTS

| | | | | |
|---|---|---|---|---|
| 3,180,037 | A | 4/1965 | Bing et al. | |
| 3,266,166 | A | 8/1966 | Heinrich | |
| 4,207,683 | A | 6/1980 | Horton | |
| 4,519,145 | A | 5/1985 | Mandel | |
| 4,984,317 | A * | 1/1991 | Christ | 8/149.1 |
| 5,146,693 | A * | 9/1992 | Dottor et al. | 34/77 |
| 5,419,469 | A | 5/1995 | Urso | |
| 2002/0069465 | A1 | 6/2002 | Chute et al. | |

FOREIGN PATENT DOCUMENTS

| | | |
|---|---|---|
| EP | 0 816 552 A2 | 1/1998 |
| EP | 0 953 669 A2 | 11/1999 |
| EP | 1 431 443 | 6/2004 |
| WO | WO 02/14594 A1 | 2/2002 |

OTHER PUBLICATIONS

Patent Abstracts of Japan, vol. 015, No. 202, May 1991, JP 03 055100, English Abstract.
Patent Abstracts of Japan, vol. 018, No. 610, Nov. 1994, JP 06 233898, English Abstract.

* cited by examiner

*Primary Examiner*—Kenneth Rinehart
(74) *Attorney, Agent, or Firm*—Pearne & Gordon LLP

(57) ABSTRACT

The present invention relates to a clothes drying machine, or combined clothes washing and drying machine, comprising a drum (1) holding the clothes to be dried, a conduit (2, 10) adapted to convey a flow of drying air into said drum and out thereof, a fan (5) adapted to blow a first flow of drying air through said said conduit, a heatin element (4) adapted to heat up the air in said conduit at a location upstream of said drum, a motor (7) adapted to selectively drive said drum rotatably. In the machine there is provided a means (9) for producing atomised moisture, said means being adapted to release a flow of said atomised moisture into said conduit according to selected times and modes.

8 Claims, 3 Drawing Sheets

CLOTHES DRYING MACHINE WITH CLOTHES SMOOTHING ABILITY

DESCRIPTION

The present invention refers to an improved kind of clothes drying machine, preferably of the type for use in households, which, along with a regular performance ability of drying clothes, is also capable of giving the possibility for an action to be exerted on the clothes, which satisfactorily replicates, although not in a fully identical manner, the effects of a mild ironing operation.

Although reference to a regular, autonomous clothes drying machine will be made throughout the following description, it shall be appreciated that what is set forth below may similarly be applied to and, therefore, be suitable for combined clothes washing and drying machines.

Clothes drying machines are largely known in the art to generally operate according to different principles and modes, including the condenser mode, i.e. the operation based on the condensation of the moisture contained in the stream of drying air flowing out of the drum, and the exhaust mode, in which dais flow of moisture-laden hot air is exhausted outside the machine.

These machines are largely known to be substantially implemented by installing a ventilation system, i.e. usually a blower formed by a fan and an electric motor associated thereto, and a heating arrangement, which draw air from the outside and, via an appropriate conduit arrangement, heat up such air and blow it into and through the drum holding the clothes items to be dried.

Within an above-mentioned conduit there is installed a heating element which, when appropriately energized, heats up the air that flows over it as blown by said blower, so that air is let into the drum which is sufficiently hot to cause the moisture contained in the clothes to evaporate.

Therefore, upon having been so blown into the drum, the hot air causes the moisture contained in the clothes to evaporate and becomes almost saturated, or even fully saturated, by this evaporated moisture. The hot moisture-laden air is then forced further by said blower to create a continuous flow that is either conveyed into and through an appropriate condensation arrangement or is exhausted directly outside, as already hinted hereinbefore.

After the drying process is completed, the clothes generally appear to be in a well visible state of crumpling, i.e. appreciably wrinkled. This wrinkled state of the clothes comes about even with other drying processes, whether natural or artificial, as are largely known as such in the art.

In view of straightening out and doing away with such aesthetically unappealing crumpled state thereof, the clothes of various kinds generally undergo an ironing process that is carried out in various manners with the use of various apparatuses. A couple of ironing methods that can be cited here as belonging to the most largely known ones include manual ironing, with the use of a hand-operated iron, and pressing with a mangle. Another method, such as disclosed for instance in EP 0 953 669 B1 or EP 0 816 552 B1, provides for the clothes to be dried to be introduced in an appropriate cabinet, in which they are then conveniently hung. A moist and hot atmosphere is then created within this cabinet, in such a manner as to cause the wrinkles existing in the clothes to more readily smooth out, while also taking advantage of the force of gravity, which acts by assisting in keeping the hanging clothes duly outstretched.

Equally well-known in the art, however, is the fact that such ironing methods also have a number of unavoidable limitations and drawbacks. Manual ironing, as carried out at home with the usual hand-operated iron, is in fact an operation that not only requires a lot of care, but is also rather laborious, tiresome and time consuming. The combined effect of these inconveniences causes ironing to be ranked among of the most disliked ones of all household-keeping chores.

Ironing with a mangle is certainly faster to perform, but is more of a process of an industrial nature that poorly fits in a household, i.e. residential environment, owing to its implying the availability and use of equipment that takes a lot of space and is quite demanding and awkward in use. Moreover, ironing with a mangle does not prove as accurate and gentle as many delicate or care-demanding items surely demand for acceptable smoothing results.

Smoothing of clothes in a cabinet is on the contrary a process that failed to gain general acceptance, i.e. is not used to any significant extent, owing to a number of reasons. A first one among these reasons certainly lies in the need for an additional and, above all, bulky electric appliance, i.e. the drying cabinet, to be purchased and installed in the home. Another reason lies in the rather long operating times involved by this process, while, after all, the end results ensured by the process, although bringing in some improvement, do not this to any really significant extent.

While this last fact, i.e. the slightly improved smoothing results, might also prove acceptable in many cases that do not require any strong, intensive ironing (which would anyway bear no comparison with manual ironing with a hand-operated iron), it nevertheless contributes, when combined with the other two above-mentioned major drawbacks, to make this process, and the related equipment, rather unacceptable altogether, as this is on the other hand demonstrated by its very limited diffusion on the marketplace, i.e. its practical inability of gaining any significant foothold.

In addition, there are a number of cases in practice, in which clothing items, such as shirts or the like, while having been already used, are not so soiled as to require a traditional washing treatment and would on the contrary just call for being delivered a mild ironing treatment in order to regain a fresh and clean appearance.

Such a treatment might therefore avert a need for a traditional washing and subsequent ironing procedure to be carried out. Nevertheless, it would imply the need for an ironing process, albeit a mild one, to be anyway carried out and, as already noted above, such operation is a generally undesired one that is not so lightheartedly accepted by those who must perform it, owing to both the time and the effort required.

Disclosed in U.S. Pat. No. 5,419,469 is an apparatus that is capable of removing wrinkles and creases from clothing items. Such apparatus is mainly comprised of a stationary dummy including an air-permeable bag, on which the clothing item to be treated is fitted.

A flow of treatment medium in a gaseous form, which may for instance consist of steam or a jet of atomised water, is introduced in the permeable bag. By flowing through the permeable wall of this bag, said treatment medium comes eventually in contact with the fabrics of the clothing item to be treated and, owing to the combined effect of both moisture and heat, smoothes the wrinkles off the treated item.

However, even this process has the drawback of requiring the use of a special, dedicated apparatus, so that it does by no way bring any practical improvement over the afore indicated ironing process in a cabinet.

It would therefore be desirable, and it is actually a main object of the present invention, to provide a clothes drying machine, which, further to being to ensuring usual clothes drying performance capabilities, is also able to treat the clothes being dried so as to impart an effect resembling a mild ironing treatment.

Within this general object, it is further a purpose of the present invention to provide such ability of the machine so that it is adapted to carry out the process in a fully automatic manner, while the clothes washing machine of the present invention must itself be such as to avoid any significant increase in its complexity and overall manufacturing costs, while ensuring fully acceptable performance characteristics. The machine must furthermore be capable of being manufactured and implemented with the use of readily available means and devices as generally known as such in the art.

According to the present invention, this aim is reached, along with further ones that will be apparent from the following description, in a clothes drying machine with clothes smoothing ability incorporating the features as recited in the appended claims.

Anyway, features and advantages of the present invention will be more readily understood from the description that is given below by way of non-limiting example with reference to the accompanying drawings, in which.

Figure 1:
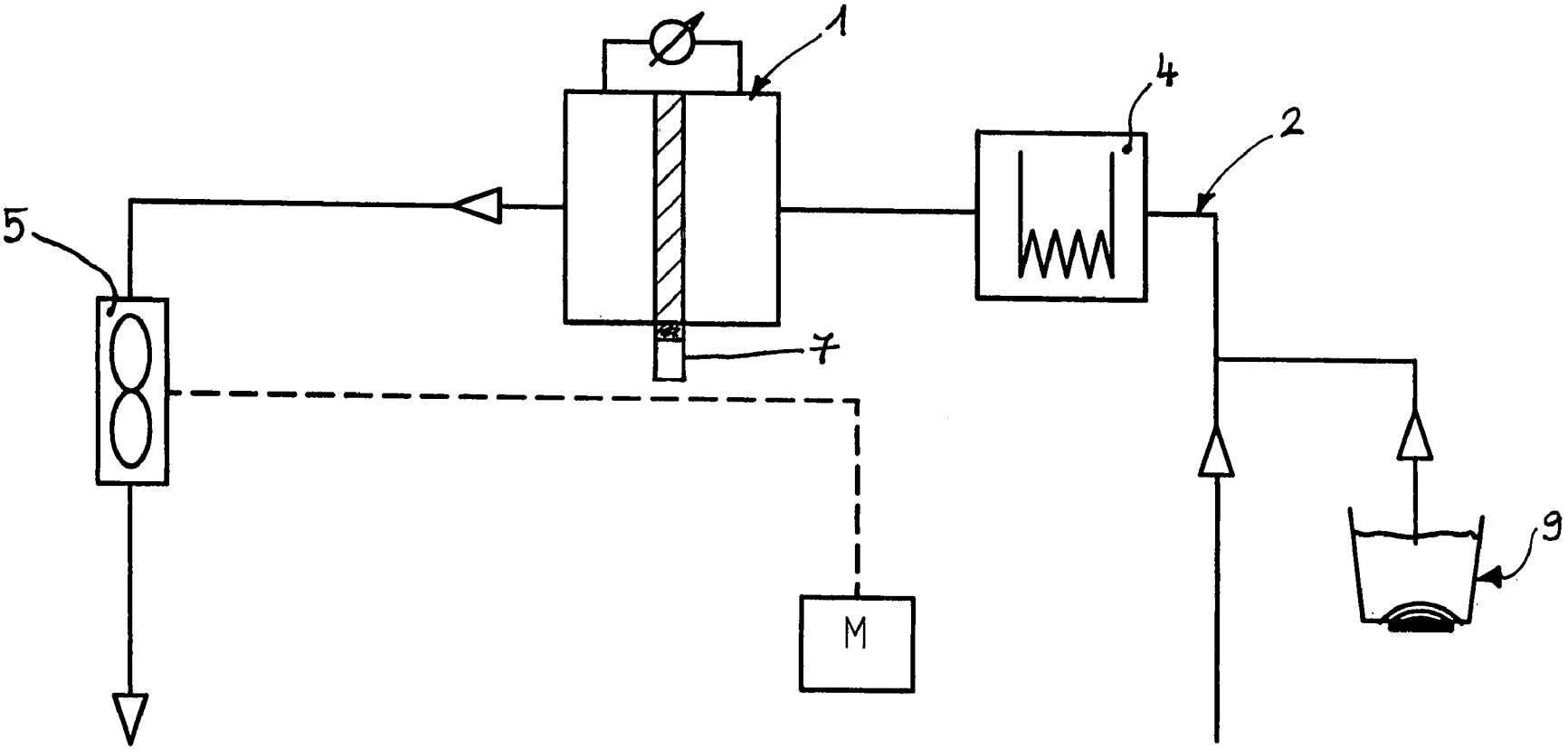
FIG. 1 is a symbolical, schematic view of the circuits and the basic component parts of a clothes drying and smoothing machine according to the present invention.

With reference to FIG. 1, in a clothes drying machine according to a prior-art, simplified embodiment there is provided a drum 1 adapted to hold the clothes to be dried, to which there is associated a conduit 2 for the drying air to be circulated therethrough, a fan 5 adapted to blow a first flow of drying air through said conduit, an electric heating element 4 adapted to heat up the air at a location in said conduit situated upstream of said drum, a motor 7 adapted to selectively drive said drum rotatably with the help of generally known means. According to the present invention, at a position in said conduit which is again situated upstream of the drum, there is arranged a means 9 that is adapted to bring about an ejection of a mass, in a quasi-gaseous form, of atomised water, which mixes immediately with the stream of drying air flowing through the same conduit. The purpose of such mass of atomised water is to humidify the air flowing therethrough, so that, upon entering the drum holding the clothes, it is therefore able to humidify the clothes to be treated.

This means for producing a jet of atomised water may most easily and appropriately be selected among a wide variety of ultrasound atomisers available on the market and largely known as such in the art. Reference may in fact be made in this connection to the patent publication WO 02/14594, which discloses a kind of clothes washing and treating machine that makes exactly use of an ultrasound atomiser of this kind to spread a cleaning or refreshing liquid or gel onto the fabrics of the clothing items to be treated.

After a certain period, during which the clothes are allowed to undergo a humidification within the drum that keeps rotating, the production of atomised water and, as a result, the issuance of the above-mentioned jet of atomised water is stopped and, at the same time, a drying cycle of a traditional type is started.

It is in fact a largely known and experimentally confirmed phenomenon that, if a dry clothing item featuring wrinkles and creases is allowed to undergo a slightly humidification for a certain period of time, said wrinkles are alleviated to a varying extent or are even eliminated (depending on a number of factors that are of no actual relevance in this context), during such humidification procedure. Moreover, if the same clothing item is subsequently allowed to go through a drying procedure without causing it to undergo creasing under any appreciable pressure, or causing it to remain creased for a certain period of time (so that the creases themselves would become permanent), the almost smoothed-out state of the clothes obtained during the previous humidification procedure is preserved and even enhanced.

At this point, it can be clearly inferred that the humidification/drying procedure as described above is fully capable of reaching the purposes of the present invention as set forth hereinbefore. It in fact comprises:

a phase of slight humidification of the clothes, during which the clothes themselves are not anyway really wetted, and a phase of subsequent drying in which, owing exactly to the reason that it is not carried out on wet clothes, and it takes place in a rotating drum, there can take place neither a compression of the clothes, since these are substantially dry, and therefore lightweight, so that they cannot exert any substantial pressure onto the underlying layers, nor a phenomenon of permanent creasing of the fabrics, since the continuous rotation of the drum keeps the clothes tumbling and moving all the time.

The solution that has been just described above, although proving effective from a functional point of view, has however a major drawback in that, upon having flown through the drum, the humidified air is exhausted from the machine, thereby losing the humidity contained therein. This practically makes it necessary for the humidity generator means 9 to be actually oversized, with all additional costs and problems that such oversizing brings with it.

Figure 2:
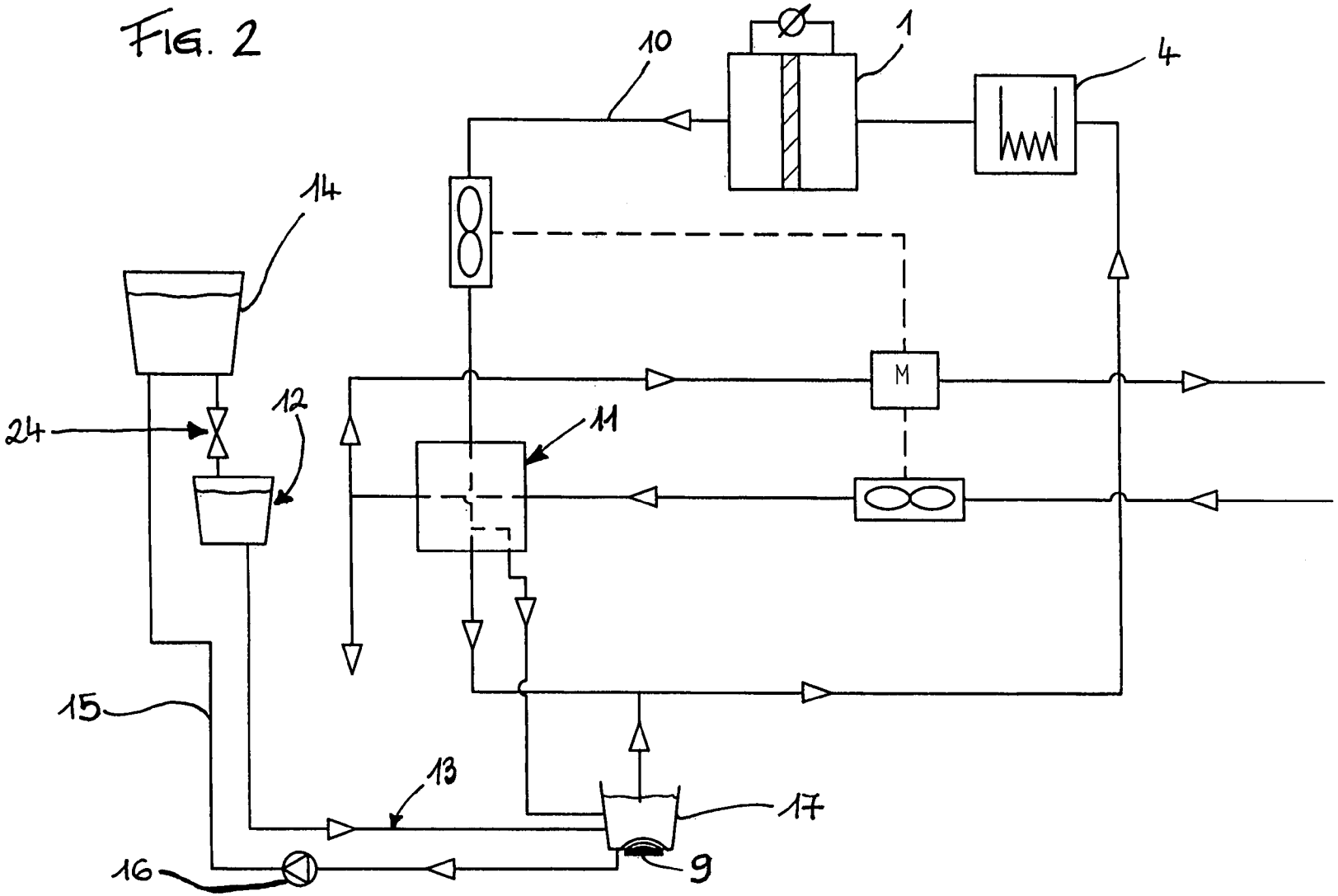
FIG. 2 is a symbolical, schematic view of the circuits and the basic component parts of a clothes drying and smoothing machine according to the present invention, which is however provided additionally with a moisture condensation circuit.

In view of doing away with this drawback, a preferred embodiment of the present invention is intended for application to a condenser-type clothes drying machine, as this is illustrated in FIG. 2. The hot drying air in this type of machine is largely known to be caused to re-circulate through a closed-loop circuit 10, in which there is provided an appropriate condenser arrangement 11 of a kind generally known as such in the art.

The humidity generator means 9 may in theory be situated at any location whatsoever along the circuit 10. However, for an optimum location thereof, it must of course be positioned in the section of the circuit 10 that lies anywhere between said condenser 11 and said drum 1, so as to prevent part of the humidity contained in the air in the circuit 10 from being otherwise condensed and exhausted immediately.

While it is true that, anyway, all of the air in the circuit 10 eventually flows through the condenser, the proposed solution allows on the other hand for the whole amount of humidity generated by the generator means 9 to be first used to practical advantage, prior to its being condensed, however only partially, in the condenser arrangement.

Figure 3:
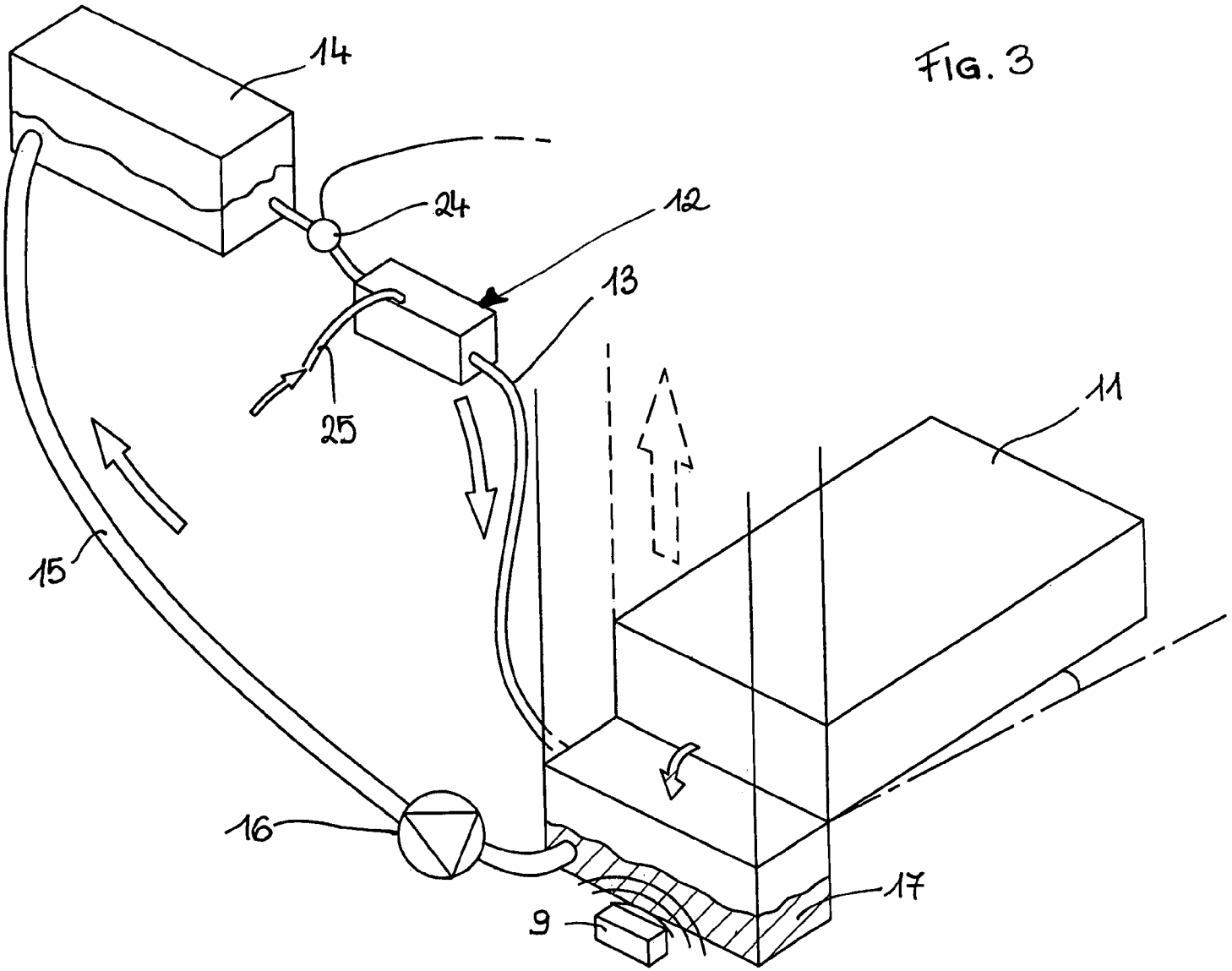
FIG. 3 is a simplified view of some devices, and the related water connections, included in the machine according to the present invention.

Referring now to FIGS. 2 and 3, the water needed for the humidity generator 9 to work properly may advantageously be taken from an auxiliary reservoir 12 via an appropriate conduit 13. This auxiliary reservoir is of paramount importance in view of a correct and proper operation of the machine in the mode of utilization thereof being discussed here. In fact, in a preferred embodiment the water used for the atomised humidity generator 9, and taken from said auxiliary reservoir 12, is derived from a primary reservoir 14, which is in turn supplied from a second conduit 15 provided to collect the condensation water from an appropriate pan or container 17, in which it collects from the condenser 11, and convey it into said primary reservoir 14, preferably by means of a pump 16.

As this can be easily inferred, when said collection pan 17 fills up with water owing to the condensation process taking place during the actual drying cycle being performed by the machine, this water is taken off by said pump and transferred into said primary reservoir 14 in a controlled manner, with the use of such control means as largely known as such in the art (not shown in the Figures).

In addition, water supply to said auxiliary reservoir 12 may be controlled and actuated in a more complete manner by means of a controlled valve 24 provided at a location along the conduit section extending from said primary reservoir 14 and said auxiliary reservoir 12.

When said primary reservoir 14 is on the contrary totally emptied, said auxiliary reservoir 12 can advantageously be supplied with water via a delivery conduit 25 (see FIG. 3), which is suitably adapted to supply, with the help of generally known means (not shown), a controlled flow of water into said auxiliary reservoir 12.

An advantageous improvement consists in arranging said generator means 9 on the bottom of said collection pan 17, so that said generator means 9 can be either supplied directly with the water collecting in said pan, owing to its being directly poured thereinto by the condenser, or, if the pan is empty, be selectively supplied with water taken from said auxiliary reservoir 12.

During the operation of the machine in the clothes-smoothing mode thereof, a first working phase is carried out, in which following functions take place:

rotation of the drum 1, operation of the fan 5, and issuance of atomised moisture by said atomising means 9.

Even the heating element 4 may be energized during this first phase, in order to heat up the air that flows through the drum 1. This has the double effect of promoting the vaporization of the atomised moisture in the same air and contributing to smoothing out creases and wrinkles in the clothes, since it has been found, on the basis of extensive experiments that have been carried out in this connection, that a slight increase in the temperature of the fabrics while being tumbled in the drum, is effective in improving the relaxation and the smoothing effect thereof.

Upon completion of said first phase, the fabrics in the drum will be in a duly smoothed-out state, but—of course—still moist. Therefore, for the treatment to be completed, the need generally arises for a second working phase to be carried out. This consists of a drying procedure of a traditional type, i.e. involving following functions:

rotation of the drum 1, operation of the fan 5, and discontinued issuance of atomised moisture by said atomising means 9, energization of the heating element 4.

In an advantageous manner, suitable means of a generally known kind are used during said first working phase to measure the level of the moisture in the drum; these measurements will be used to determine the moment at which the generation and issuance of atomised moisture must be stopped along with the concurrent relaxation and smoothing-out of the clothes in the drum, as well as the moment at which said second working phase, i.e. the drying phase must be started. While working or cycle times may be pre-set in a rigid manner through an usual timer or the like, it is a generally known and experimentally corroborated fact that an accurate timing of the various phases of operation certainly improves the overall result, reduces energy usage and shortens cycle times.

The invention claimed is:

1. Clothes drying machine, or combined clothes washing and drying machine, comprising a drum (1) holding the clothes to be dried, a conduit (2, 10) adapted to convey a flow of drying air into said drum and out thereof, a fan (5) adapted to blow a first flow of drying air through said conduit, a heating element (4) adapted to heat up the air in said conduit at a location upstream of said drum, a motor (7) adapted to selectively drive said drum rotatably, a means (9) for producing atomizing moisture, said means being adapted to release a flow of said atomized moisture into said conduit according to selected times and modes, a condenser (11) through which said flow of drying air is caused to circulate, said moisture atomizing means (9) at least partially using condensation water produced by said condenser, a pan (17) adapted to collect the condensation water produced by said condenser, and a primary reservoir (14) adapted to be supplied via an appropriate conduit (15) with the water coming from said pan and to deliver this water to said moisture atomizing means (9), said conduit (15) being provided with a selectively operable pump (16) located between said pan and said primary reservoir.

2. Machine according to claim 1, characterized in that between said primary reservoir (14) and said means (9) there is arranged a related conduit (13), at an intermediate location of which there is provided an auxiliary reservoir (12).

3. Machine according to claim 2, characterized in that in the section of said conduit (13) that extends between said primary reservoir (14) and said auxiliary reservoir (12) there is provided a controlled value (24).

4. Machine according to claim 2 or 3, characterized in that there is provided a delivery conduit (25) adapted to supply said auxiliary reservoir (12) with liquid, preferably water.

5. Machine according to claim 1, characterized in that it is provided with a selectively controllable operating mode including a first working phase involving at least the following functions:

rotation of the drum, production and delivery of atomized moisture, operation of the fan, and possible energization of the heating element (4).

6. Machine according to claim 5, characterized in that it is further provided with a second working phase consisting of a drying procedure performed with the use of known means and operating modes that are inherently provided and already available in the machine.

7. Machine according to claim 6, characterized in that the moisture contained within said drum is measured during at least part of said first working phase and said second working phase.

8. Clothes drying machine, or combined clothes washing and drying machine, comprising a drum (1) holding the clothes to be dried, a conduit (2, 10) adapted to convey a flow of drying air into said drum and out thereof, a fan (5) adapted to blow a first flow of drying air through said conduit, a heating element (4) adapted to heat up the air in said conduit at a location upstream of said drum, a motor (7) adapted to selectively drive said drum rotatably, a means (9) for producing atomizing moisture, said means being adapted to release a flow of said atomized moisture into said conduit according to selected times and modes, a condenser (11) through which said flow of drying air is caused to circulate, said moisture atomizing means (9) at least partially using condensation water produced by said condenser, a pan (17) adapted to collect the condensation water produced by said condenser, and a primary reservoir (14) adapted to be supplied via an appropriate conduit (15) with the water coming from said pan and to deliver this water to said moisture atomizing means (9), said means (9) for producing atomized moisture being arranged within said pan (17).

* * * * *

UNITED STATES PATENT AND TRADEMARK OFFICE

CERTIFICATE OF CORRECTION

PATENT NO. : 7,162,812 B2
APPLICATION NO. : 11/042309
DATED : January 16, 2007
INVENTOR(S) : Silvano Cimetta and Flavio Noviello It is certified that error appears in the above-identified patent and that said Letters Patent is hereby corrected as shown below:

On the Title Page:

In Item (75): Please delete the name "Fabio" and insert --Flavio--

Signed and Sealed this

Twelfth Day of June, 2007

JON W. DUDAS
*Director of the United States Patent and Trademark Office*